US012352125B2

(12) United States Patent
Huang et al.

(10) Patent No.: US 12,352,125 B2
(45) Date of Patent: Jul. 8, 2025

(54) COMBINED SEALING MEMBER FOR COILED TUBING BLOWOUT PREVENTER BOX

(71) Applicant: Guangzhou JST Seals Technology Co., Ltd., Guangdong (CN)

(72) Inventors: Guangming Huang, Guangdong (CN); Jialiang Wang, Guangdong (CN); Houning Li, Guangdong (CN)

(73) Assignee: Guangzhou JST Seals Technology Co., Ltd., Guangzhou (CN)

( * ) Notice: Subject to any disclaimer, the term of this patent is extended or adjusted under 35 U.S.C. 154(b) by 194 days.

(21) Appl. No.: 18/131,363

(22) Filed: Apr. 6, 2023

(65) Prior Publication Data

US 2024/0125195 A1 Apr. 18, 2024

(30) Foreign Application Priority Data

Oct. 12, 2022 (CN) ..... 202222693932.1

(51) Int. Cl.
*E21B 33/06* (2006.01)

(52) U.S. Cl.
CPC ..... *E21B 33/06* (2013.01)

(58) Field of Classification Search
CPC .. E21B 47/117; E21B 220/01; E21B 33/1208; E21B 41/0042
USPC ..... 251/1.1, 1.2, 1.3, 363; 166/88; 277/343, 277/925
See application file for complete search history.

(56) References Cited

U.S. PATENT DOCUMENTS 1,038,244 A * 9/1912 Wagner ..... E21B 33/04 285/123.5
2,207,149 A * 7/1940 Hild ..... E21B 33/085 175/218
5,092,400 A * 3/1992 Jagert ..... E21B 33/08 166/212
5,515,925 A * 5/1996 Boychuk ..... E21B 33/0422 166/382
5,697,439 A * 12/1997 Kopfman ..... E21B 33/0422 166/88.3
6,192,981 B1 * 2/2001 Boquet ..... E21B 19/10 188/67
7,552,765 B2 * 6/2009 Lam ..... E21B 33/062 166/85.4

FOREIGN PATENT DOCUMENTS

CA 2133724 C * 7/1996 ..... E21B 33/0422

* cited by examiner

*Primary Examiner* — Daphne M Barry

(57) ABSTRACT

A combined sealing member for a coiled tubing blowout preventer box includes an upper plate, a first main sealing body, a second main sealing body and a lower plate that are disposed in sequence from top to bottom and are each provided with a through hole allowing a coiled tubing to pass therethrough. The upper plate is composed of two upper plate units that are separable half-and-half. The first main sealing body is composed of two first main sealing body units that are separable half-and-half. The second main sealing body is composed of two second main sealing body units that are separable half-and-half. The lower plate is composed of two lower plate units that are separable half-and-half. The first main sealing body has a hardness greater than that of the second main sealing body and a height smaller than that of the second main sealing body.

8 Claims, 1 Drawing Sheet

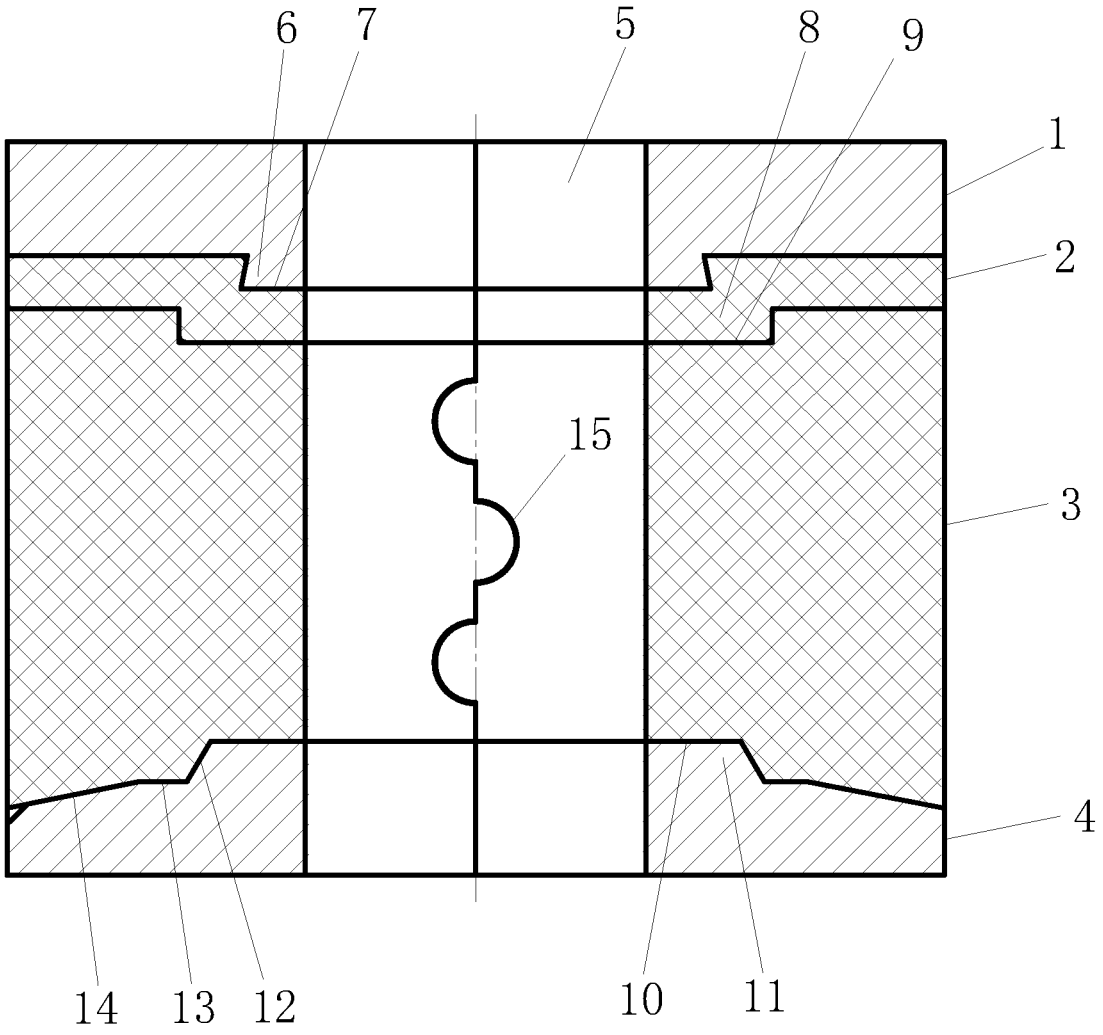
6
7
5
8
9
1
2
15
3
4
14
13
12
10
11

COMBINED SEALING MEMBER FOR COILED TUBING BLOWOUT PREVENTER BOX

CROSS REFERENCE TO RELATED APPLICATIONS

The present application claims the benefit of Chinese Patent Application No. 202222693932.1 filed on Oct. 12, 2022, the contents of which are incorporated herein by reference in their entirety.

TECHNICAL FIELD

The present disclosure relates to the field of sealing components, and in particular to a combined sealing member for a coiled tubing blowout preventer box.

BACKGROUND

Coiled tubing is a continuously synthesized tubing which is manufactured with a required length and can be wound around a roller. A steel material for the tubing has a yield strength of from 55,000 Psi to 120,000 Psi. The longest tubing that can be wound around a single roller put into commercial use at present is more than 9,000 meters.

A coiled tubing apparatus is mainly composed of:

(1) a roller configured to store and convey the coiled tubing;

(2) an injection head configured to provide power for taking off the coiled tubing;

(3) an operating cab in which a facility operator monitors and controls the coiled tubing;

(4) a power unit configured to be a hydraulic power source required for operating the coiled tubing apparatus; and (5) a well control device configured to be a well head safety device for the operation of the coiled tubing under pressure.

The well control device is a key part for the operation of the coiled tubing. A typical well control device for a coiled tubing usually includes a blowout preventer (BOP) stack and a blowout preventer box connected to an upper portion of the blowout preventer. The blowout preventer box is provided with a sealing member for isolating the pressure in a wellbore, which is usually mounted between the BOP stack and the injection head.

Existing sealing members for a blowout preventer box are mostly single-component polyurethane products. When working, the sealing member is mounted in the blowout preventer box. Two packing metal rings are placed on the top and a bottom of the blowout preventer box, respectively, to press the sealing member under the action of a hydraulic force, causing the sealing member to deform. The coiled tubing passing therethrough is enclosed tightly to form a pre-seal so that the wellbore pressure below can be isolated.

However, commercially available sealing members have short service life. The reciprocating motion of the coiled tubing through a sealing member and the presence of media such as water, mud and oil in the well below may lead to tubing surface with poor quality, i.e., surface having scratches and attached with some liquid and mud particles. Such a coiled tubing surface may undergo repeated friction with the sealing member, leading to wear and flaking of the sealing member. To prevent the damage of the metal materials caused by rubbing with each other, clearances are usually formed between the upper and lower packing metal rings and the outer diameter of the tubing. The body material of the sealing member may be pressed into the clearances under the action of a downhole pressure and escape to the outside continuously, leading to increasingly reduced size of the sealing member and deteriorating pre-sealing effect. When the sealing member is worn to a certain extent, sealing may fail.

In addition, the sealing member may have an integrated structure in most cases. That is, the coiled tubing needs to be inserted into the sealing member from top to bottom. The operating processes of mounting and dismounting are complicated, and also prone to causing wear of the sealing member, especially accelerating the wear of the upper portion of the sealing member to cause failure of the whole sealing member.

SUMMARY

To solve the above-mentioned technical problems, an objective of the present disclosure is to provide a combined sealing member for a coiled tubing blowout preventer box that has the advantages of convenient mounting and dismounting, good sealing performance, good wear resistance and long service life.

The present disclosure adopts the following technical solutions: a combined sealing member for a coiled tubing blowout preventer box includes an upper plate, a first main sealing body, a second main sealing body and a lower plate that are disposed in sequence from top to bottom. The upper plate, the first main sealing body, the second main sealing body and the lower plate are each provided with a through hole allowing a coiled tubing to pass therethrough. The upper plate is composed of two upper plate units that are separable half-and-half. The first main sealing body is composed of two first main sealing body units that are separable half-and-half. The second main sealing body is composed of two second main sealing body units that are separable half-and-half. The lower plate is composed of two lower plate units that are separable half-and-half. The first main sealing body has a hardness greater than that of the second main sealing body and a height smaller than that of the second main sealing body.

In a preferred solution of the present disclosure, a bottom portion of the upper plate may be provided with a dovetailed protrusion, while a top portion of the first main sealing body may be provided with a dovetailed groove; and the dovetailed protrusion may be in matching connection with the dovetailed groove.

In a preferred solution of the present disclosure, a bottom portion of the first main sealing body may be provided with a columnar protrusion, while a top portion of the second main sealing body may be provided with a columnar groove; and the columnar protrusion may be in matching connection with the columnar groove.

In a preferred solution of the present disclosure, a bottom portion of the second main sealing body may be provided with a truncated cone-like groove, while a top portion of the lower plate may be provided with a truncated cone-like protrusion; and the truncated cone-like protrusion may be in matching connection with the truncated cone-like groove.

In a preferred solution of the present disclosure, the truncated cone-like protrusion may be provided with a first inclined surface, a second inclined surface and a third inclined surface in sequence in a radial direction from inside to outside. The first inclined surface, the second inclined surface and the third inclined surface may be all inclined toward a same side. The first inclined surface may have a greater inclination angle than the second inclined surface and the third inclined surface, and the second inclined surface may have a smaller inclination angle than the third inclined surface.

In a preferred solution of the present disclosure, the two second main sealing body units that are separable half-and-half may be engaged and sealed with each other by means of a concave-convex structure.

In a preferred solution of the present disclosure, a height ratio of the first main sealing body to the second main sealing body may be 1:9 to 1:4.

In a preferred solution of the present disclosure, the first main sealing body and the second main sealing body may be both made of polyurethane.

In a preferred solution of the present disclosure, the upper plate and the lower plate may be both made of polytetrafluoroethylene or modified polytetrafluoroethylene.

Compared with the prior art, the combined sealing member for a coiled tubing blowout preventer box provided in the present disclosure has the following beneficial effects.

The combined sealing member for a coiled tubing blowout preventer box provided in the present disclosure has a separated structure. The upper plate, the first main sealing body, the second main sealing body and the lower plate are all designed to be composed of half-and-half separable units to facilitate passing and dismounting of the coiled tubing. Moreover, the hardness of the first main sealing body is designed to be greater than that of the second main sealing body, so that the degree of wear of the upper portion (i.e., the first main sealing body) of the sealing member by the coiled tubing can be effectively reduced when the coiled tubing is inserted from top to bottom, rendering the service life of the first main sealing body approximately the same as that of the second main sealing body. Accordingly, the service life of the whole main sealing body is prolonged, and the maintenance cost of the sealing member is reduced.

BRIEF DESCRIPTION OF THE DRAWINGS

To describe the technical solutions in the embodiments of the present disclosure more clearly, a brief introduction to the accompanying drawings for the embodiments will be provided below.

The sole FIGURE is a structural schematic diagram of a combined sealing member for a coiled tubing blowout preventer box according to an embodiment of the present disclosure.

LIST OF REFERENCE NUMERALS

1—upper plate, 2—first main sealing body, 3—second main sealing body, 4—lower plate, 5—through hole, 6—dovetailed protrusion, 7—dovetailed groove, 8—columnar protrusion, 9—columnar groove, 10—truncated cone-like groove, 11—truncated cone-like protrusion, 12—first inclined surface, 13—second inclined surface, 14—third inclined surface, and 15—concave-convex structure.

DETAILED DESCRIPTION

The present disclosure will be described in more detail below with reference to the accompanying drawings and embodiments. The following embodiments are illustrative of the present disclosure and are not intended to limit of the scope of the present disclosure.

In the description of the present disclosure, it should be understood that terms such as "upper", "lower", "left", "right", "front", "rear", "top" and "bottom" refer to orientation or position relationships in accordance with the drawings for convenience of description and for the purpose of simplicity. These terms are not intended to indicate or imply that the mentioned device or components must have a specific orientation or must be constructed and operated in a specific orientation. Therefore, these terms should not be understood as a limitation to the present disclosure. It should be understood that the terms such as "first" and "second" are used herein to describe various information which, however, should not be limited to these terms, and these terms are only used to distinguish the information of a same type from one another. For example, "first" information may be referred to as "second" information without departing from the scope of the present disclosure, and vice versa.

As shown in the sole FIGURE, a combined sealing member for a coiled tubing blowout preventer box according to a preferred embodiment of the present disclosure includes an upper plate 1, a first main sealing body 2, a second main sealing body 3 and a lower plate 4 that are disposed in sequence from top to bottom. The upper plate 1, the first main sealing body 2, the second main sealing body 3 and the lower plate 4 are each provided with a through hole 5 allowing a coiled tubing to pass therethrough. The upper plate 1 is composed of two upper plate units that are separable half-and-half. The first main sealing body 2 is composed of two first main sealing body units that are separable half-and-half. The second main sealing body 3 is composed of two second main sealing body units that are separable half-and-half. The lower plate 4 is composed of two lower plate units that are separable half-and-half.

When mounting, the sealing member is mounted in the blowout preventer box. The outer diameters of the upper plate 1, the first main sealing body 2, the second main sealing body 3 and the lower plate 4 are all completely fit with the inner wall of the blowout preventer box, while the inner diameters are fit with the coiled tubing. The coiled tubing passes through the upper plate 1, the first main sealing body 2, the second main sealing body 3 and the lower plate 4 in sequence from top to bottom, and the first main sealing body 2 and the second main sealing body 3 are pressed by an external force to form a pre-seal. When working, a clearance outside the coiled tubing and a clearance inside the blowout preventer box are sealed, thus achieving the effect of isolating the pressure in a wellbore below.

It should be noted that, since the combined sealing member for a coiled tubing blowout preventer box according to the embodiment of the present disclosure has a separated structure, the upper plate 1, the first main sealing body 2, the second main sealing body 3 and the lower plate 4 are all designed to be composed of half-and-half separable units. In such a case, when there is a need to mount and dismount the coiled tubing, the corresponding two units can be assembled or disassembled directly without inserting and pulling out the coiled tubing. The operation is thus simple and convenient.

The first main sealing body 2 has a hardness greater than that of the second main sealing body 3 and a height smaller than that of the second main sealing body 3. In the process of mounting, since the coiled tubing which is usually inserted from top to bottom may easily cause great wear of the upper portion of the main sealing body, the hardness of the upper portion (i.e., the first main sealing body 2) of the main sealing body may be designed to be greater than that of the lower portion (i.e., the second main sealing body 3) of the main sealing body, so that the degree of wear of the first main sealing body 2 can be effectively reduced, rendering the service life of the first main sealing body 2 approximately the same as that of the second main sealing body 3. Accordingly, the service life of the whole main sealing body is prolonged, and the maintenance cost of the sealing member is reduced.

Exemplarily, a bottom portion of the upper plate 1 is provided with a dovetailed protrusion 6, while a top portion of the first main sealing body 2 is provided with a dovetailed groove 7; and the dovetailed protrusion 6 is in matching connection with the dovetailed groove 7. A bottom portion of the first main sealing body 2 is provided with a columnar protrusion 8, while a top portion of the second main sealing body 3 is provided with a columnar groove 9; and the columnar protrusion 8 is in matching connection with the columnar groove 9. A bottom portion of the second main sealing body 3 is provided with a truncated cone-like groove 10, while a top portion of the lower plate 4 is provided with a truncated cone-like protrusion 11; and the truncated cone-like protrusion 11 is in matching connection with the truncated cone-like groove 10. Thus, by means of mutual matching of the concave-convex structure, the sealing member is simple and convenient to assemble, and the structure is stable and reliable.

Exemplarily, the truncated cone-like protrusion 11 is provided with a first inclined surface 12, a second inclined surface 13 and a third inclined surface 14 in sequence in a radial direction from inside to outside. The first inclined surface 12, the second inclined surface 13 and the third inclined surface 14 are all inclined toward a same side. The first inclined surface 12 has a greater inclination angle than the second inclined surface 13 and the third inclined surface 14, and the second inclined surface 13 has a smaller inclination angle than the third inclined surface 14. Thus, the specific inclination angle design to the truncated cone-like protrusion 11 can compensation to the packing force of the sealing member, and the service life of the sealing member can thus be prolonged.

Exemplarily, the two second main sealing body units that are separable half-and-half are engaged and sealed with each other by means of a concave-convex structure 15, thereby ensuring the sealing performance of the sealing member.

Exemplarily, to guarantee the wear resistance and sealability of the whole main sealing body, a height ratio of the first main sealing body 2 to the second main sealing body 3 is preferably 1:9 to 1:4.

Exemplarily, the first main sealing body 2 and the second main sealing body 3 are both preferably made of polyurethane.

Exemplarily, the upper plate 1 and the lower plate 4 are both made of polytetrafluoroethylene or modified polytetrafluoroethylene. In this embodiment, the upper plate 1 and the lower plate 4 are both preferably made of the polytetrafluoroethylene modified by adding carbon fiber (e.g., graphite). The modified polytetrafluoroethylene has good wear resistance and has a small coefficient of relative friction with the coiled tubing and a lower hardness than the metal material of the coiled tubing. There is no need to worry about causing wear to the coiled tubing even without any clearance. Thus, the sealing member can be prevented from being pushed out.

In the description of the present disclosure, it should be noted that, unless otherwise clearly specified, terms "connected with" and "connected to" should be understood in a board sense. For example, the connection may be a fixed connection, a removable connection, or an integral connection; may be a mechanical connection or an electrical connection; may be a direct connection or an indirect connection by using an intermediate medium; or may be intercommunication between two components. A person of ordinary skill in the art may understand specific meanings of the foregoing terms in the present disclosure based on a specific situation.

The foregoing are merely descriptions of the preferred embodiments of the present disclosure. It should be noted that several modifications and equivalents can be made by a person of ordinary skill in the art without departing from the technical principle of the present disclosure, and these modifications and equivalents shall also be deemed as falling within the protection scope of the present disclosure.

The invention claimed is:

1. A combined sealing member for a coiled tubing blowout preventer box, comprising an upper plate, a first main sealing body, a second main sealing body, and a lower plate that are disposed in sequence from top to bottom, wherein the upper plate, the first main sealing body, the second main sealing body, and the lower plate are each provided with a through hole allowing a coiled tubing to pass therethrough;

the upper plate is composed of two upper plate units that are separable half-and-half; the first main sealing body is composed of two first main sealing body units that are separable half-and-half; the second main sealing body is composed of two second main sealing body units that are separable half-and-half; the lower plate is composed of two lower plate units that are separable half-and-half; and the first main sealing body has a hardness greater than a hardness of the second main sealing body and a height smaller than a height of the second main sealing body, wherein a bottom portion of the second main sealing body is provided with a truncated cone-like groove, while a top portion of the lower plate is provided with a truncated cone-like protrusion; and the truncated cone-like protrusion is in matching connection with the truncated cone-like groove.

2. The combined sealing member for a coiled tubing blowout preventer box according to claim 1, wherein a bottom portion of the upper plate is provided with a dovetailed protrusion, while a top portion of the first main sealing body is provided with a dovetailed groove; and the dovetailed protrusion is in matching connection with the dovetailed groove.

3. The combined sealing member for a coiled tubing blowout preventer box according to claim 1, wherein a bottom portion of the first main sealing body is provided with a columnar protrusion, while a top portion of the second main sealing body is provided with a columnar groove; and the columnar protrusion is in matching connection with the columnar groove.

4. The combined sealing member for a coiled tubing blowout preventer box according to claim 1, wherein the truncated cone-like protrusion is provided with a first inclined surface, a second inclined surface and a third inclined surface in sequence in a radial direction from inside to outside; the first inclined surface, the second inclined surface and the third inclined surface are all inclined toward a same side; the first inclined surface has a greater inclination angle than the second inclined surface and the third inclined surface, and the second inclined surface has a smaller inclination angle than the third inclined surface.

5. The combined sealing member for a coiled tubing blowout preventer box according to claim 1, wherein the two second main sealing body units that are separable half-and-half are engaged and sealed with each other by means of a concave-convex structure.

6. The combined sealing member for a coiled tubing blowout preventer box according to claim 1, wherein a height ratio of the first main sealing body to the second main sealing body is 1:9 to 1:4.

7. The combined sealing member for a coiled tubing blowout preventer box according to claim 1, wherein the first main sealing body and the second main sealing body are both made of polyurethane.

8. The combined sealing member for a coiled tubing blowout preventer box according to claim 1, wherein the upper plate and the lower plate are both made of polytetrafluoroethylene or modified polytetrafluoroethylene.

* * * * *